United States Patent [19]

Miyazaki et al.

[11] 4,224,777

[45] Sep. 30, 1980

[54] PACKAGING PAPER NEAR END DETECTING DEVICE IN COIN PACKAGING MACHINE

[75] Inventors: Yorizo Miyazaki; Hideshi Sentoku; Katusuke Furuya, all of Tokyo, Japan

[73] Assignee: Laurel Bank Machine Co., Ltd., Tokyo, Japan

[21] Appl. No.: 18,271

[22] Filed: Mar. 7, 1979

[30] Foreign Application Priority Data

Mar. 13, 1978 [JP] Japan ..... 53/28402

[51] Int. Cl.[3] ..... B65B 57/08; B65B 57/18; B65B 11/04

[52] U.S. Cl. ..... 53/641; 53/508; 53/212

[58] Field of Search ..... 53/508, 64, 66, 212

[56] References Cited

U.S. PATENT DOCUMENTS

| | | | |
|---|---|---|---|
| 2,879,636 | 3/1959 | Zuercher | 53/64 X |
| 3,455,213 | 7/1969 | Seragnoli | 53/508 X |

*Primary Examiner*—Travis S. McGehee
*Attorney, Agent, or Firm*—Fleit & Jacobson

[57] ABSTRACT

A coin packaging machine for packaging different kinds of coins is provided with means for supplying coins, means for transporting the supplied coins while selecting a kind of coins out during transportation, means for accumulating transported coins, delivery means for receiving accumulated coins and delivering the coins from receiving position to packaging position, means for supplying a web of paper within packaging zone and means for clamping the packaged coins. The coin packaging machine further includes means for making various adjustments of the above mentioned means in accordance with the thickness and the width of the coins to be packaged. The coin packaging machine is also provided with a packaging paper near end detecting device. The detecting device is constructed so that when no packaging paper is present, an alarm is issued and the machine is stopped after the completion of the packaging operation.

4 Claims, 2 Drawing Figures

PACKAGING PAPER NEAR END DETECTING DEVICE IN COIN PACKAGING MACHINE

BACKGROUND OF THE INVENTION

This invention relates to a coin packaging machine, more particularly to a packaging paper near end detecting device in a packaging machine in which a predetermined number of accumulated or stacked coins is packaged or wrapped in packaging paper and the packaging of the coins is completed by bending inwardly the upper and lower edges of the packaging paper by clamping claws.

Heretofore, there has never been proposed a packaging paper near end detecting device for use in a packaging machine which can forewarn the operator of the absence of packaging paper or let him know the condition of the near end of the packaging paper.

SUMMARY OF THE INVENTION

It is, therefore, an object of the invention to provide a novel packaging paper near end detecting device for use in a packaging machine which can let operator to know of the absence or the condition of the near end of the packaging paper in advance.

It is another object of the invention to provide a packaging paper near end detecting device of the above type in which complete packaging operations are continued until the packaging paper is depleted and the continuation of the packaging operation is prevented when the packaging paper runs out.

In accordance with the present invention there is provided a packaging paper near end detecting device in a coin packaging machine which comprises a charging stand supporting on its surface a roll of a packaging paper, a paper feed rollers provided on the charging stand and a detecting mechanism provided on the charging stand for detecting the presence of the packaging paper at a position where a distance between the detecting mechanism and the packaging zone is at least greater than one packaging length of the packaging paper and in which when the packaging paper is not present, an alarm is made by issuing a light or a sound by the detecting mechanism and in the event that the packaging paper does not become present during the packaging operation, the machine is stopped after the completion of the packaging operation.

More particularly, the detecting mechanism comprises an idle roller provided on the charging stand at a position where the distance between the idle roller and the packaging zone is slightly greater than one packaging length of the packaging paper and a switch positioned opposite to the idle roller. The packaging paper is supplied between the idle roller and the switch and then between the paper feed rollers to the packaging zone. The switch is provided with an actuator for detecting the presence of the packaging paper between the idle roller and the switch. When the trailing end of the packaging paper passes between the idle roller and the switch during the packaging operation or when no packaging paper is present, the switch is energized to detect the absence of the packaging paper. However, in the former case, the packaging paper still remains by a length sufficient for one packaging of the coins and the supply of the packaging paper is continued and a complete packaging operation is made.

In the above construction, the packaging paper can be automatically completely used and, therefore, no waste occurs. Further, no failure of packaging which would be caused due to the lack of the packaging paper occurs either.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will be now described in detail with the reference to the accompanying drawings.

Figure 1:
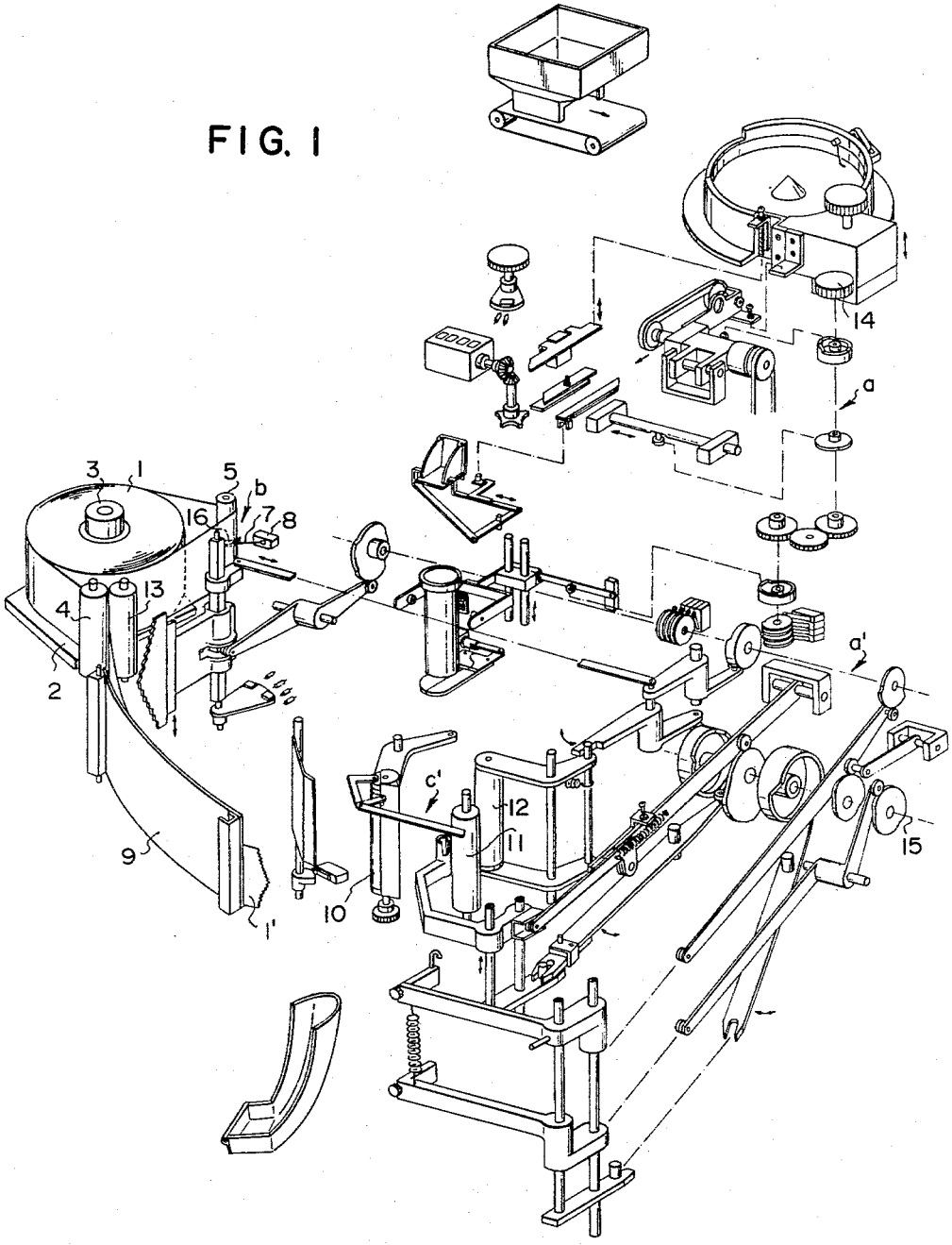
FIG. 1 is a fragmentary perspective view showing the entire structure of the coin packaging machine according to the present invention.
Figure 2:
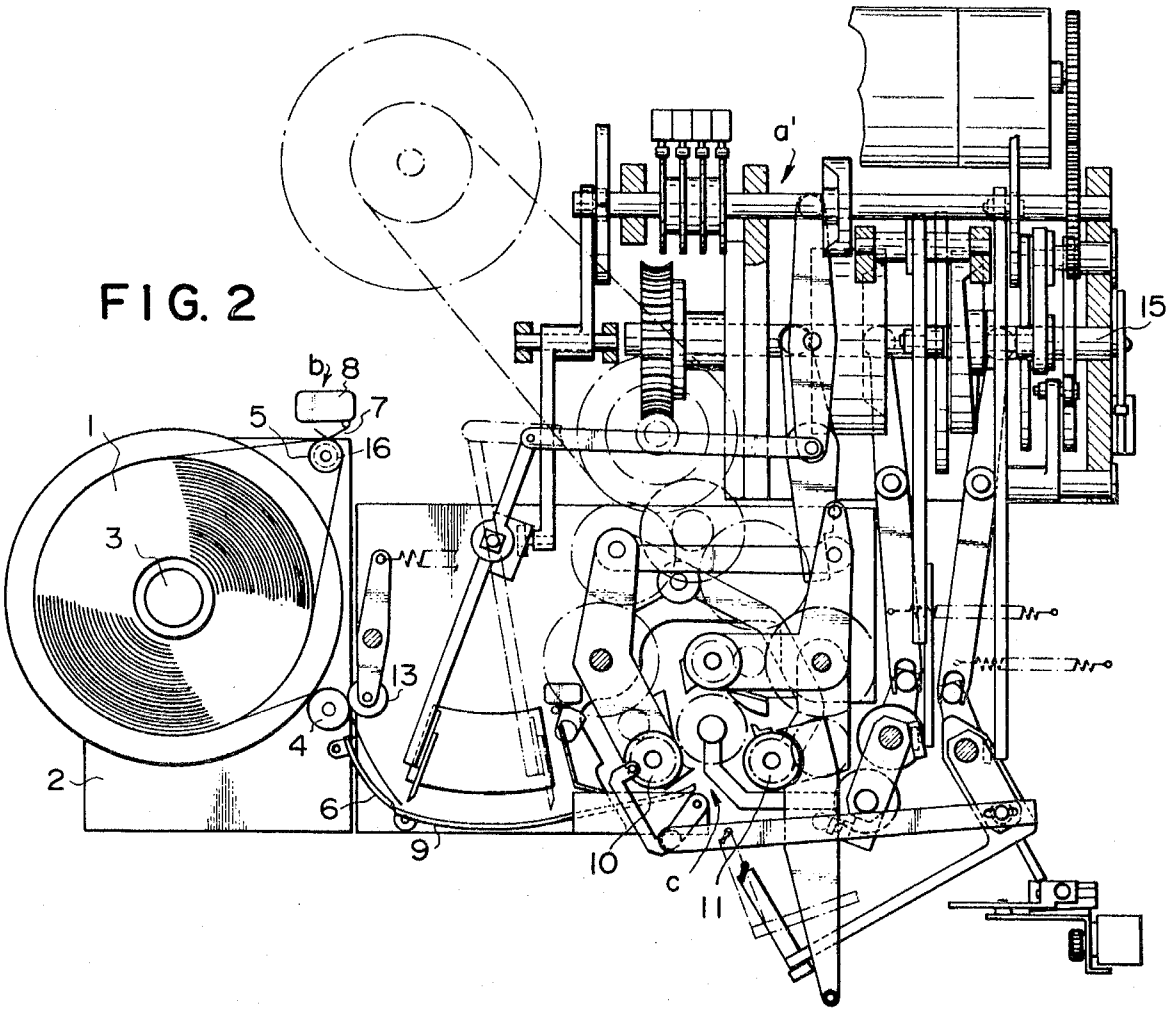
FIG. 2 is a plan view showing the packaging mechanism.

FIG. 1 shows the construction of the coin packaging machine to which the present invention relates. As, however, the details of this machine have been described in Japanese Patent Application No. 96417/77 which was filed by the same applicant as that of the present application, only the main portions related to the present invention will be described and the other portions not related to the present invention will be omitted.

A charging table 2 for charging a packaging paper 1 thereon is mounted so as to be pulled or removed out of a body of the coin packaging machine in order to facilitate the supplement or replacement of the packaging paper. The roll of the packaging paper 1 is fitted on a metal core 3.

Provided on the charging table 2 are a driven feed roller 4 for feeding the packaging paper 1 into a packaging mechanism c and a rotatable idle roller 5 forming a portion of a detecting mechanism b. A guide 6 may be provided, if necessary.

At the body side of the coin packaging machine, a near end switch 8 with a actuator 7, forming the other portion of the detecting mechanism b is provided opposite to the idle roller 5 and a guide plate 9 is provided so as to be continuous with the guide 6, so that the leading end 1' of the packaging paper 1 is introduced into the packaging mechanism c comprising three packaging rollers 10, 11 and 12. A driving feed roller 13 provided at the body side is adapted to be engaged with the driven feed roller 4 through the packaging paper 1 to feed the packaging paper out toward the packaging mechanism c.

It should be noted that the idle roller 5 of the detecting mechanism b, mounted on the charging table 2 is positioned so that the length of the packaging paper from the mounted position of the idle roller 5 to the leading end 1' of the packaging paper is made slightly greater than the length of the packaging paper required for packaging one roll of the accumulated coins.

In operation, the charging table 2 disposed within the body of the coin packaging machine is first pulled out of the body of the coin packaging machine and the packaging paper 1 is fitted on the metal core 3. The length of the packaging paper required for packaging one roll of the coins is pulled out through the idle roller 5, the feed roller 4 and the guide 6. In such a condition, the charging table 2 is returned to be disposed again within the body of the coin packaging machine. Thus, the idle roller 5 becomes engaged with the actuator 7 through the packaging paper 1 and the feed roller 4 becomes press engaged with the feed roller 13 through the packaging paper 1.

In the above-mentioned condition, when a coin kind setting mechanism a is manually set by means of a coin kind setting member 14 operatively associated with the coin kind setting mechanism in accordance with the kind of the coins to be packaged, the respective sections of operation are set in accordance with the selected coin kind through the respective setting members including the coin kind setting mechanism a, an adjustment mechanism a', etc. in order to be ready for packaging operation.

The packaging operation is started by depressing a start button (not shown). The packaging of the coins proceeds and the remaining supply of packaging paper decreases. When the remaining packaging paper comes to amount to the length required for one packaging operation or slightly more, the packaging paper still exists between the idle roller 5 and the actuator 7 and thus the final packaging operation will be made with the remaining packaging paper. On the contrary, in the event that the remainder of the packaging paper is too short for a packaging operation, the actuator 7 will have contacted the idle roller 5 during the preceding cycle of the packaging. When the actuator 7 contacts the idle roller 5, the actuator 7 energizes the near end switch 8 to let the operator to know the near end condition of the packaging paper by issuing an auditory or visual alarm. During the preceding packaging cycle, since a one-revolution cam 15 is rotating, the coin packaging machine is constructed so as not to be stopped until one revolution of the cam shaft has completed, that is, the packaging operation has been completed. Thereafter, the operator can pull out the charging table to replace the remaining packaging paper with a new roll of packaging paper.

At the above-mentioned detecting mechanism b, in the case that the thickness of one sheet of the packaging paper is less than that required for actuation of the switch, for examples, as illustrated in Figure, the idle roller 5 may be provided with a circumferential groove 16 opposite to the actuator 7. Alternatively, the absence of the packaging paper may be detected by means of a light sensing device instead of the above-mentioned mechanical detecting mechanism.

What is claimed is:

1. A packaging paper near end detecting device for use in connection with the performance of a packaging operation with respect to a roll of packaging paper moving along a path in a coin packaging machine, said packaging paper having a leading end and a packaging length, said device comprising:

a charging stand supporting on its surface said roll of packaging paper, paper feed rollers provided on the charging stand, a detecting mechanism for detecting the absence of the packaging paper so as to issue a detection signal provided on the charging stand at a position where the distance along the path of the packaging paper between the detecting mechanism and the leading end of the packaging paper is at least greater than the packaging length of the packaging paper, and means for stopping the machine after the completion of the packaging operation in response to said detection signal of the detecting mechanism during the packaging operation.

2. A device as set forth in claim 1, wherein said detecting mechanism includes means for issuing an alarm.

3. A device as set forth in claim 2, wherein said alarm includes a light.

4. A device as set forth in claim 2, wherein said alarm comprises a sound.

* * * * *